US005555801A

United States Patent [19]

Kroyer

[11] Patent Number: 5,555,801

[45] Date of Patent: Sep. 17, 1996

[54] APPARATUS AND METHOD FOR MANUFACTURING A DOUBLE-SIDED EMBOSSING FIBROUS WEB AND SUCH DOUBLE-SIDED WEB

[76] Inventor: Karl K. K. Kroyer, Le Vieux Moulin, 12, rue de la Libération, F-06520 Magagnosc, France

[21] Appl. No.: 431,826

[22] Filed: May 1, 1995

Related U.S. Application Data

[63] Continuation of Ser. No. 141,928, Oct. 28, 1993, abandoned.

[51] Int. Cl.[6] ..... B31F 1/07; B44C 1/24

[52] U.S. Cl. ..... 101/32; 101/23

[58] Field of Search ..... 101/3.1, 5, 6, 22, 101/23, 25, 32

[56] References Cited

U.S. PATENT DOCUMENTS

| | | | |
|---|---|---|---|
| 1,388,641 | 8/1921 | Harrigan | 101/23 |
| 1,656,170 | 1/1928 | Cooper | 101/23 X |
| 1,744,829 | 1/1930 | Dreyfus | 101/25 X |
| 2,838,416 | 6/1958 | Babiarz et al. | 101/22 X |
| 3,024,154 | 3/1962 | Singleton et al. | 101/23 X |
| 3,418,925 | 12/1968 | Wiggins | 101/23 |
| 3,655,312 | 4/1972 | Erb et al. | 101/23 X |
| 3,850,095 | 11/1974 | Snyder | 101/32 |
| 4,007,767 | 2/1977 | Colledge | 101/25 X |
| 4,732,082 | 3/1988 | Ireton | 101/23 |
| 5,115,737 | 5/1992 | Amendola | 101/32 |

*Primary Examiner*—Christopher A. Bennett

*Attorney, Agent, or Firm*—Watson Cole Stevens Davis, P.L.L.C.

[57] ABSTRACT

A double-sided three dimensional embosssed web is provided by passing an uncured paper or plastic web (15), through a nip between an embossing roller (18) and a pressure roller (19), the pressure roller having a smooth and hard surface to create the effect of a double-sided three dimensional embossing on the web. Such double-sided embossing gives the web a good hand and feel and a good drapability, thereby making the method suitable for manufacturing cloth, curtains, diapers and other products which should feel soft and pleasant and which should have a good drapability comparable with that of knitwear and textiles. The embossed web has embossing or impressions (24) provided on two surfaces as a mirror image around a plane of symmetry (23) passing through the middle of the web (15). In the same way raised areas (26) are opposed by raised areas (26).

11 Claims, 4 Drawing Sheets

APPARATUS AND METHOD FOR MANUFACTURING A DOUBLE-SIDED EMBOSSING FIBROUS WEB AND SUCH DOUBLE-SIDED WEB

CROSS-REFERENCE TO RELATED APPLICATION

This is a continuation of application Ser. No. 08/141,928, filed Oct. 28, 1993, now abandoned.

BACKGROUND OF THE INVENTION

This invention relates to an apparatus and a method for providing a fibrous web with embossings on both sides, thereby creating a double-sided three dimensional embossed web.

The fibers to be used in the present invention comprise cellulosic fibers, wood fibers, mixtures with synthetic fibers including bicomponent fibers and synthetic fibers. The synthetic fibers may, e.g., be of polypropylene or polyethylene. Also glass fibers, rock wool fibers, and pretreated fibers may be used.

The invention also relates to the fibrous web itself. The embossing process is an in-line process by which the web formed is led through a so-called embossing calendar. The web may be a plastic web, a paper web or the like. It is also possible to emboss a multi-layer web.

The embossing calendar comprises an embossing roller and a cooperating pressure roller and between which the web is led in order to emboss one side of the web. If a double-sided embossing is provided, the web is led through a further embossing calendar having the embossing roller and the pressure roller arranged oppositely in relation to the positioning in the first embossing calendar. Thus, the prior technique results in a voluminous apparatus.

Serious problems occur if the double-sided embossing is effected simultaneously by the use of two embossing rollers. Thus, a great risk exists that the web will be broken in areas where two raised portions are arranged opposite each other in a central plane passing through the axis of rotation for the two embossing rollers. This risk for breaking or rupturing of the web is especially high when thin webs are embossed.

For many products it is a desire to have double-sided embossed webs and it is desired that such web could be rather thin. When having double-sided embossing the web would have a high quality in hand and feel and also in drapability. Thus, a sheet being embossed only at one side would have a very poor drapability, being governed by the non-embossed surface of the web. Moreover, a web being embossed only at one surface would feel more stiff and hard. Accordingly, it is said to have a poor hand feel. When embossing the web at both sides, the web will a lot of points around which the web is able to bend. This is the effect which gives the web a good hand feel and a good drapability. Such web is especially suitable for manufacturing cloths, curtains, wash cloths, diapers, and other products which should feel soft and pleasant for users or which should have a drapability to be compared with that of knitwear and textiles. The web may be manufactured with reinforcements nets, synthetic fibers included in the cellulosic fibers or be made solely of cellulosic fibers.

It is the object of the present invention to provide a fibrous web having an embossing on both surfaces in order to provide a web having a good hand feel and a good drapability, irrespective of the thickness of the web.

SUMMARY OF THE INVENTION

According to the present invention the double-sided embossing of the fibrous web is provided simultaneously by leading the web between two rollers. One of the rollers is a embossing roller know per se and the other roller is a pressure roller being provided with a hard and smooth surface. Surprisingly, it has been shown that the use of a hard and smooth pressure roller in contradiction to the well-known soft pressure roller creates the effect of a double-sided three dimensional embossing. Even after great consideration of this surprising effect the inventor has not been able to give a causal explanation. The embossings provided on the two surfaces of the web occur as a mirror image around a symmetry plane passing through the middle of the web. Thus, an impression at one side of the web would be opposed by an impression at the other side of the web.

According to a preferred embodiment the second roller is made of a chromium-plated steel roller providing a very hard and smooth surface. Thereby an especially good and concise embossing is obtained on both sides.

The two rollers used should be arranged with a mutual distance between the surfaces so that no nip effect would occur on the material of the web which is situated in register with indentations on the embossing roller. Thus, it is preferred that the two rollers are set, depending on the thickness of the web and the type of the web so that embossing only occurs in the material of the web which is situated in register with the raised areas of the embossing roller.

The rollers used can have various dimensions. Thus the length can be between 3 and 4 meters and the diameter can be between 0.1 and 0.7 meters. The surface speed of the roller can be between 20 and 400 meters/minute and the rollers should preferably be heated to a temperature between 130° C. and 400° C., preferably between 200° and 330° C.

When providing embossings on both sides in the method according to the invention, it is possible to establish the web-manufacturing plant with an over-all size which is less than when using conventional embossing methods requiring the use of two subsequent embossing calendars. The web produced can preferably be arranged with very short distances, e.g., less than 3 mm or even less than 2 mm, between the raised areas in order to have as many bending points as possible.

Further features and advantages of the present invention will be understood by reference to the attached drawings taken in conjunction with the ensuing discussion.

DETAILED DESCRIPTION OF THE PREFERRED EMBODIMENT

Figure 1:
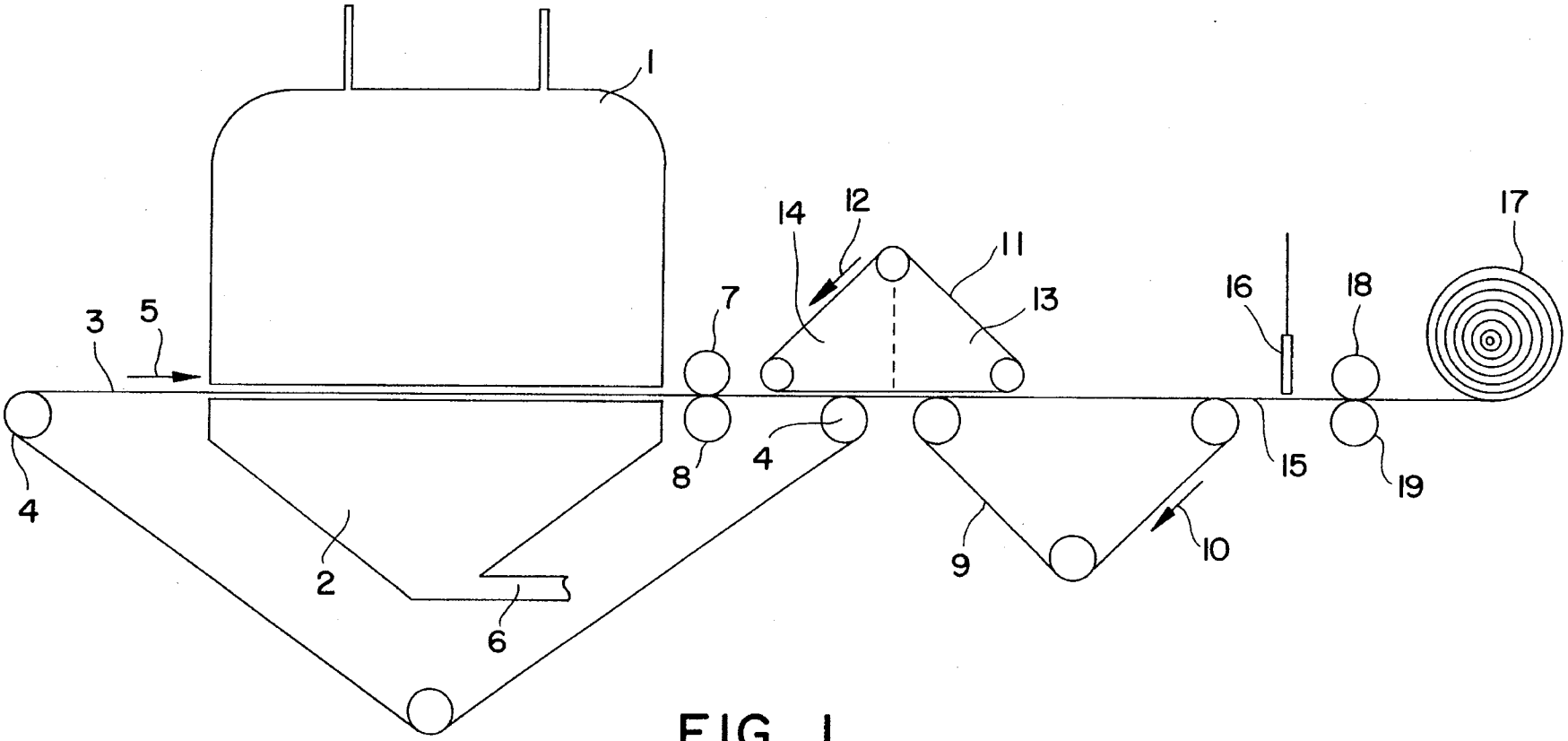
FIG. 1 shows a schematic side view of an apparatus according to the invention.

FIG. 1 illustrates schematically a plant for dry laying of paper. In FIG. 1 only main elements of the plant are illustrated. Thus, in order to function the plant would require more elements such as binder supply means, a curing unit and means for conditioning the web formed. However, such elements are within the knowledge of the skilled in the art and a detailed explanation thereof will not be necessary for the understanding of the present invention which is related to the embossing. It is preferred to arrange the curing unit after the embossing rollers. However, it is also possible to arrange the curing unit before the embossing roller.

The plant comprises a fiber distributor 1, a suction box 2 and an endless foraminous forming wire 3 passing therebetween. The endless forming wire 3 consists, e.g., of a mesh net constructed using bronze wires. The forming wire 3 is supported on rollers 4 and is driven by suitable driving means (not shown) so that it will continously pass between the fiber distributor 1 and the suction box 2. The forming wire 3 moves in direction of an arrow 5.

The suction box 2 comprises a suction pipe 6 which is connected to a fan (not shown) for creating a vacuum therein. The forming wire 3 passes through the nip of a pair of rollers 7, 8. Thereby a compaction of the dry laid fibers is effected.

An endless band 9 is arranged in continuation of the forming wire 3. The band 9 is driven in direction of an arrow 10. A further endless band 11 is provided above the forming wire 3 and a part of the endless band 9. The interior of the endless band 11 is divided into two compartments 13, 14 having an overpressure and a vacuum, respectively. This arrangement is intended for transferring the fibrous web 15 formed from the forming wire 3 to the endless band 9.

Spraying nozzles 16 are arranged above the fibrous web 15. The spraying nozzles 16 may be used to adjust the humidity of the web within limits between 5 and 10%, preferably within 7 to 8%. This humidity is essential as problems otherwise may occur due to static electricity.

It is possible to provide spraying nozzles corresponding to the nozzles 16 at the other side of the fibrous web 15. Before winding up the final fibrous web 15 onto a roller 17, the web 15 passes through the nip of the rollers 18, 19.

The rollers 18, 19 constitute an embossing apparatus according to the invention. The roller 18 is provided with a pattern in its surface determining the form of the embossing of the web. The roller 19 which is a so-called pressure roller has a smooth and hard surface. The roller 19 is preferably made of a chromium-plated steel roller. Thus, the pressure roller 19 is totally different from the pressure rollers which are ordinarily used. These prior art rollers are based on the principle that they should have a soft and flexible surface which may yield when embossing the web. However, such known embossing apparatus allows only for an embossing on one surface of the web. In this respect it should be remembered that a one-sided embossed web would have a drapability governed on the smooth side.

Figure 2:
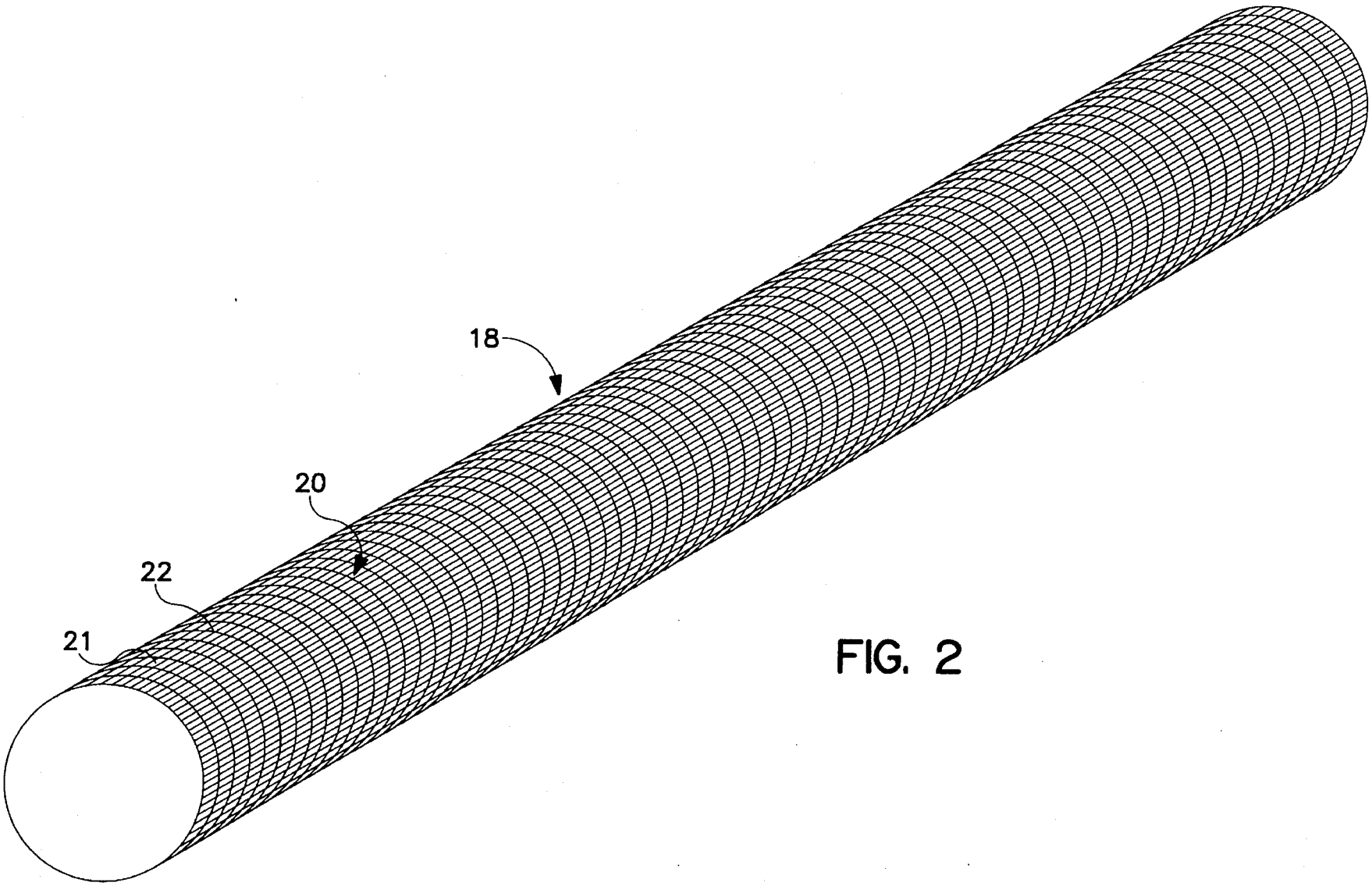
FIG. 2 shows an enlarged view of an embossing roller.

As illustrated in FIG. 2 the roller 18 is provided with a pattern 20 comprising engraved areas 21 and raised areas 22. The rollers 18, 19 is provided with a mutual distance so that the nip effect would occur in fibers situated in register with the raised areas 21 and so that no nip effect would occur in the fibers situated in register with the engraved areas 21. Thus there is a demand for a very precise positioning of the two rollers 18, 19.

The apparatus according to the invention works according to a method by which a double-sided three dimensional embossing is effected on the fibrous web 15. Such a double-sided embossed fibrous web is illustrated in FIGS. 3 and 4.

Figure 3:
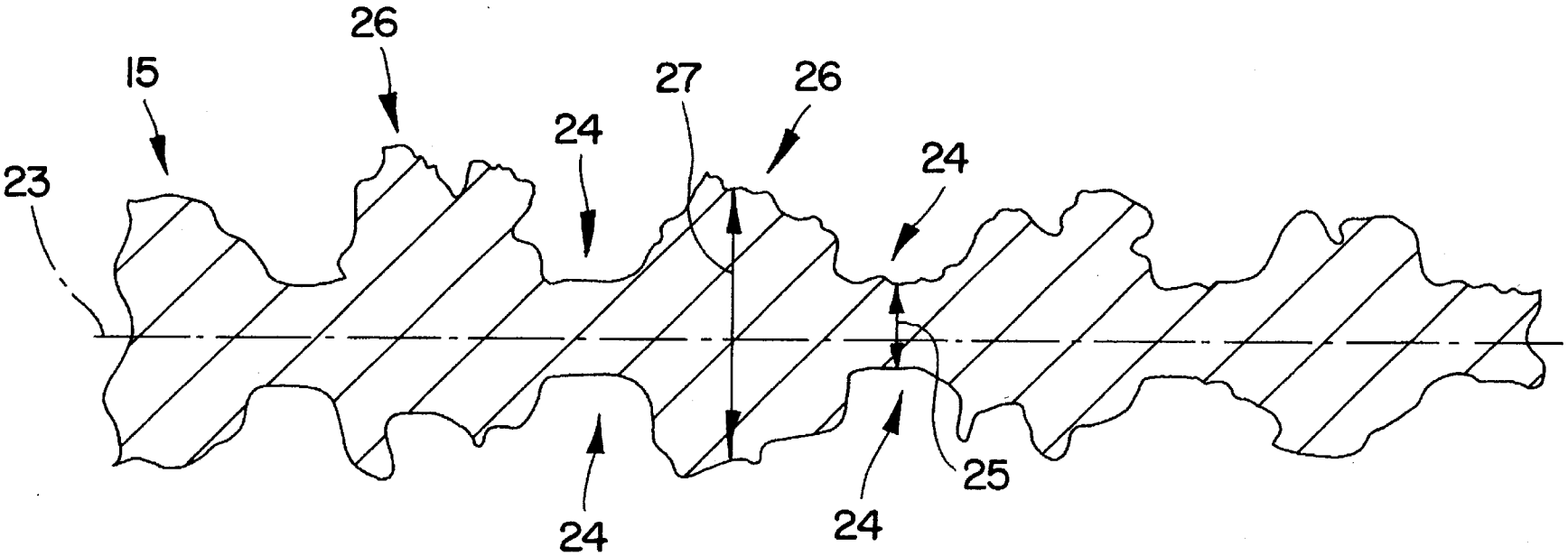
FIG. 3 shows a partial sectional view through a web made according to the present invention.

FIG. 3 is a partial sectional view illustrating that the embossed web occurs with the embossings being a mirror-image in an imaginary plane of symmetry 23 passing through the middle of the fibrous web 15. As explained above it has surprisingly been shown that embossings are provided on both sides even though the pressure roller 19 is smooth. Thus an impression 24 at one side of the web 15 is opposed by an impression 24 on the other side of the web 15. Areas 26 between the impression have a thickness 27 being greater than the thickness 25 across two impressions 24.

Figure 4:
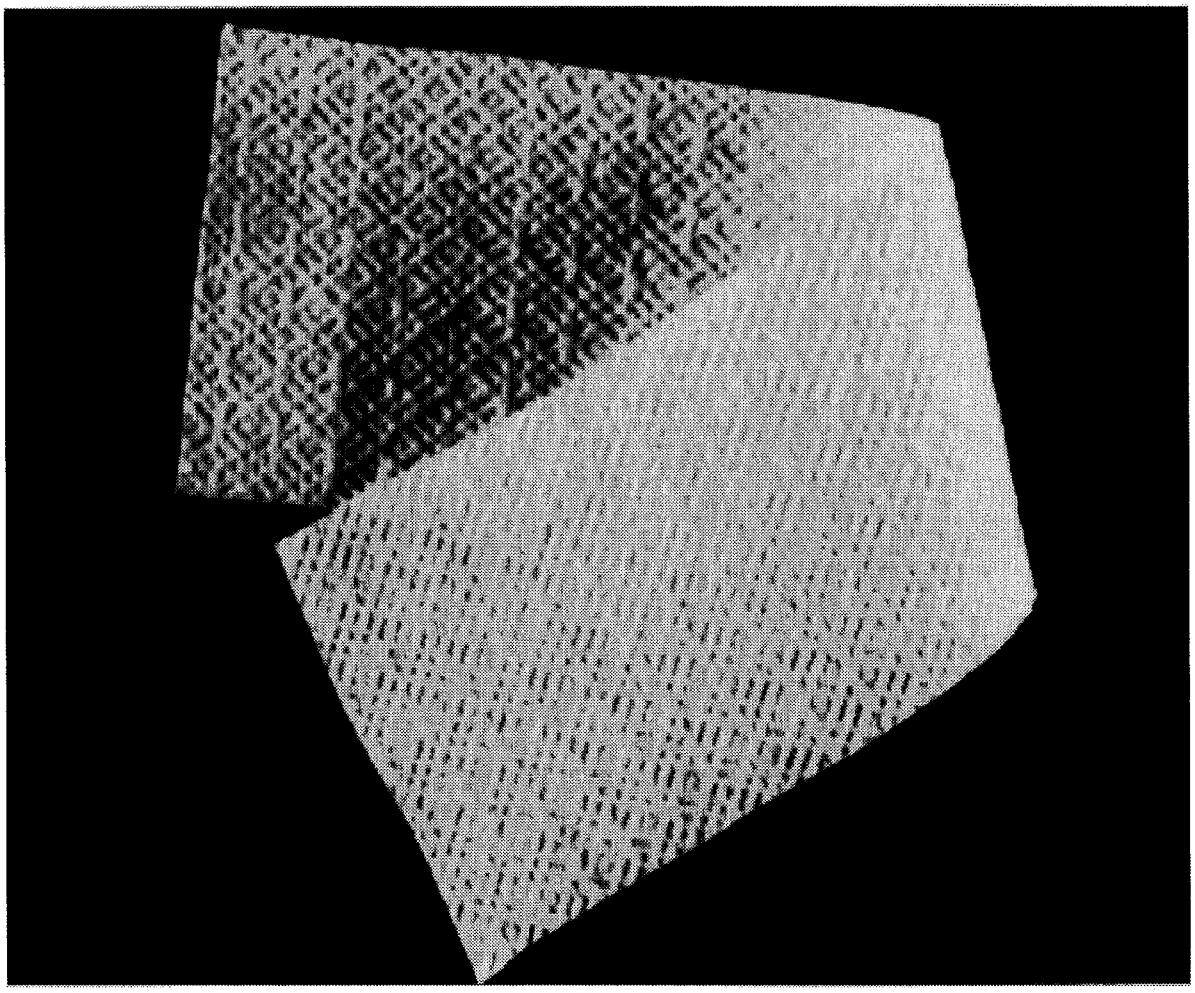
FIG. 4 shows a photography of a web according to the present invention.

FIG. 4 shows a part of a web manufactured according to the invention in which the embossing occurs as impressions and raised or non-compressed areas.

The apparatus according to the invention operates in the following manner:

The web 15 is led through the nip between the rollers 18, 19. After having passed the nip the thickness 25 of the web between impressions 24 might be between 10 and 20% of the original thickness of the web 15. In the areas 26 between impressions the web might have a thickness 27 of approximately 2 to 3 mm whereas the thickness 25 is approximately a few tenths of a millimeter.

When heating the rollers 18, 19 it has been discovered that the product is especially soft. This effect is also surprising. It is believed that the momentary heating gives rise to a vapor formation occurring as a small explosion. It is believed that these small explosions make the product more airy and thereby softer.

Besides being soft, the product has a good hand feel and a good drapability due to the double-sided embossing. The drapability can be compared to that of knitwears and textiles. Due to the reduced thickness 25 between opposed impressions 24, the web is provided with a large number of bending points. The large number of bending points is requisite for a good drapability. The distance between adjacent impressions can be less than two millimeters in order to achieve as many bending points as possible. Thereby an especially good drapability is obtained.

When effecting the embossing it is possible to apply a modifier onto the raised areas 21 of the embossing roller 18. Thus, it is possible to modify the properties of the web during the embossing process. Such modification may be provided in the form of a colouring in the impressions 24.

It is also possible to use a penetrant as modifier. Such penetrant would enter into the fibers positioned between the opposed impressions 24 and affect the mechanical properties of the fibers. The modification is only effected at the side of the web 15 facing the embossing roller 18. A penetrant could, e.g., affect hydrophobic fibers in a way whereby they are amended into hydrophilic fibers in the pattern or a part of the pattern of the impressions. Such modified web could advantageously be used in napkins and diapers.

This effect of making so-called flow lines has been described in copending U.S. patent application Ser. No. 08/141,927, filed Oct. 28, 1993, the content thereof being hereby incorporated with reference.

I claim:

1. Apparatus for treating a fibrous web so as to provide embossings on opposite sides thereof and to provide a web which is easily bent, said apparatus comprising first and second rollers which are mounted to define a nip therebetween, said first roller having a surface pattern thereon and said second roller having a smooth and hard surface, and means to convey a fibrous web into the nip between said first and second rollers so as to contact said surface patterns of said first roller and develop embossings on both sides thereof.

2. Apparatus as defined in claim 1, wherein said second roller is a steel roller with a chromium-plated surface.

3. Apparatus as defined in claim 1, wherein said first roller has a surface of engraved areas and raised areas which define said pattern.

4. Apparatus as defined in claim 1, including means to move said first and second rollers relative to one another to determine the nip spacing therebetween.

5. A method for producing an easily bent fibrous web having embossings on opposite sides thereof comprising the steps of (a) providing first and second rollers in nip-defining relationship, said first roller having a surface pattern thereon and said second roller having a smooth and hard surface, and (b) passing a fibrous web into said nip defined between first and second rollers so as to simultaneously emboss the fibrous web on opposite sides thereof.

6. A method as defined in claim 5, including the steps of rotating the first and second rollers such that surface velocities thereof are 20 to 400 meters/minute, and heating the first and second rollers to between 130° C. to 400° C.

7. A method as defined in claim 5, including the step of adjusting the spacing between the first and second rollers such that portions of said fibrous web in register with engraved areas of said first roller are not squeezed when passing between said first and second rollers.

8. A method as defined in claim 5, including the step of applying a penetrant to raised areas of the first roller for application to said fibrous web.

9. A method for producing an easily bent fibrous web having embossings on opposite sides thereof, each embossing on one side thereof being located opposite an embossing on an opposite side thereof, said method comprising the steps of (a) air laying a fibrous web having a predetermined thickness on a forming wire, (b) providing first and second rollers, said first roller having a surface pattern thereon defined by raised areas and engraved areas and said second roller having a smooth and hard surface, (c) positioning said first and second rollers in nip-defining relationship such that said raised areas of said first roller are closer to said smooth and hard surface of said second roller than said predetermined thickness whereas said engraved areas of said first roller are farther from said smooth and hard surface of said second roller, and (d) passing said air laid fibrous web between said first and second rollers to produce said easily bent fibrous web having embossings on opposite sides thereof.

10. A method as defined in claim 9, wherein in step (a) cellulosic fibers are air laid on said forming wire.

11. A method as defined in claims 9, wherein in step (a) a mixture of cellulosic and synthetic fibers are air laid on said forming wire.

* * * * *